US007705286B2

(12) United States Patent
Tourdot et al.

(10) Patent No.: US 7,705,286 B2
(45) Date of Patent: Apr. 27, 2010

(54) PASSIVE SAFETY SYSTEM WITH A DIRECTION SENSING EXIT ZONE FOR USE IN A MOBILE STORAGE SYSTEM

(75) Inventors: Matthew A. Tourdot, Whitewater, WI (US); Brian P. Bourke, Jefferson, WI (US); William B. McHenry, Fort Atkinson, WI (US); Steven M. Lehmann, Fort Atkinson, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 0 days.

(21) Appl. No.: 11/559,971

(22) Filed: Nov. 15, 2006

(65) Prior Publication Data

US 2008/0111060 A1 May 15, 2008

(51) Int. Cl.
*G06M 7/00* (2006.01)

(52) U.S. Cl. ..... 250/221; 340/555

(58) Field of Classification Search ..... 250/221; 340/555

See application file for complete search history.

(56) References Cited

U.S. PATENT DOCUMENTS

| | | | | |
|---|---|---|---|---|
| 4,745,516 | A | 5/1988 | Griffin | 361/189 |
| 4,783,618 | A | 11/1988 | Artrip | 318/587 |
| 5,121,975 | A | 6/1992 | Dahnert | 312/201 |
| 5,160,190 | A | 11/1992 | Farrell et al. | 312/201 |
| 5,359,191 | A | 10/1994 | Griesemer et al. | 250/221 |
| 5,408,089 | A | 4/1995 | Bruno et al. | 250/221 |
| 5,427,444 | A | 6/1995 | Griesemer | 312/201 |
| 5,569,910 | A | 10/1996 | Griesemer | 250/221 |
| 5,670,778 | A | 9/1997 | Smith | 250/221 |
| 5,850,082 | A | 12/1998 | Eaton et al. | 250/221 |
| 5,854,849 | A | 12/1998 | Eaton | 382/100 |
| 6,091,064 | A | 7/2000 | Eaton et al. | 250/221 |
| 6,707,028 | B2 | 3/2004 | Housh et al. | 250/221.1 |
| 2004/0093181 | A1 * | 5/2004 | Lee | 702/150 |
| 2004/0104647 | A1 * | 6/2004 | Nemec et al. | 312/201 |
| 2006/0290243 | A1 * | 12/2006 | Smith | 312/201 |

* cited by examiner

*Primary Examiner*—Thanh X Luu
*Assistant Examiner*—Kevin Wyatt
(74) *Attorney, Agent, or Firm*—Andrus, Sceales, Starke & Sawall, LLP

(57) ABSTRACT

A mobile storage system includes a number of storage units supported by a supporting surface, including first and second storage units that are movable toward and away from each other to create an aisle. A sensing system detects the presence of persons or objects in the aisle and the direction of movement of persons or objects into or out of the aisle. The sensing system includes exit zone sensors located adjacent an end area of the storage units that defines the end area of the aisle, and inner sensors located along an inner area of the storage units inwardly of the end area. The exit zone and inner sensors are located at generally the same elevation above the supporting surface. Each of the storage units includes a carriage that is movable relative to the supporting surface, and the sensors are mounted to the carriage via a sensor housing interconnected with the carriage.

7 Claims, 6 Drawing Sheets

FIG. 4
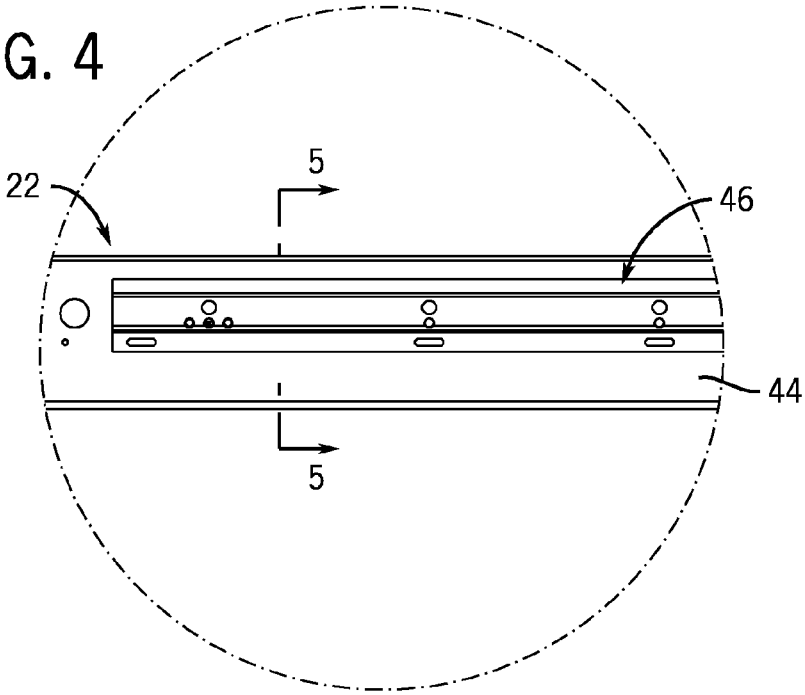
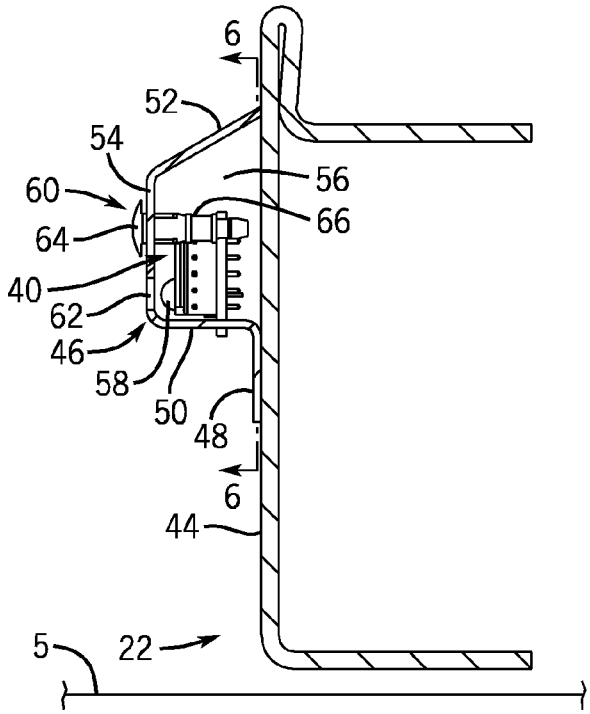
FIG. 5

PASSIVE SAFETY SYSTEM WITH A DIRECTION SENSING EXIT ZONE FOR USE IN A MOBILE STORAGE SYSTEM

BACKGROUND AND SUMMARY OF THE INVENTION

This invention relates to a mobile storage system, and more particularly to a passive safety arrangement for use in a mobile storage system.

A mobile storage system typically consists of a series of storage units that are movable on rails or the like toward and away from each other. Movement of the storage units is controlled so as to selectively create an aisle between an adjacent pair of storage units. When an aisle is created, a user enters the aisle to access an area of one or both of the storage units that form the aisle, such as to remove an object from one or more of the storage units or to place an object on or in one or more of the storage units. Mobile storage systems of this type are commonly available from a number of different manufacturers, including Spacesaver Corporation of Fort Atkinson, Wis.

A number of safety systems have been developed so as to ensure that an aisle is empty before the pair of storage units forming the aisle are closed in order to create an aisle between a different pair of storage units. In a typical configuration of a passive safety system, a series of cross-aisle sensors are positioned at spaced-apart locations throughout the length of each storage unit in an adjacent pair of storage units. The cross-aisle sensors are typically uniformly spaced a selected distance apart, e.g. on twelve inch centers, and act to sense the presence of a person or object in the aisle. The cross-aisle sensors are typically in the form of light beam emitters and receivers. The presence of a person or object in the path of one of the light beams prevents the light beam from reaching the receiver, which provides a signal to a controller that is interpreted to indicate the presence of a person or object in the aisle. In this manner, the controller is responsive to the signals so as to ensure that the adjacent storage units are not closed until the aisle between the storage units is clear of persons or objects.

In addition, prior art passive safety systems have employed a quadrature sensor at each entry or access point between adjacent mobile storage units. Each quadrature sensor typically includes a pair of light beams, which are sequentially blocked as a person or object enters or exits an aisle to indicate the direction of movement of a person or object into or out of the aisle. The quadrature sensor is typically placed at approximately knee level, which ensures that a person is not able to step over the light beams of the quadrature sensor when entering or exiting the aisle. The controller is responsive to signals from the both the quadrature sensors and the cross-aisle sensors, to ensure that adjacent storage units are not closed until it is determined that the aisle between the storage units clear and that every person or object that has entered that aisle has also exited the aisle.

While a passive safety system having the above-identified components is reliable and functions well, it involves certain drawbacks. For example, the cross-aisle sensors and the quadrature sensors are mounted to each storage unit in different locations, i.e. the cross-aisle sensors are low and close to the floor whereas the quadrature sensors are elevated above the floor. This requires separate mounting of the housings and other components of the different sensors. In addition, the cross-aisle sensors and the quadrature sensors require separate wiring. As a result, the number of parts involved in this configuration, in combination with the resulting assembly time and labor costs, increases the overall cost associated with manufacture of the storage units.

It is an object of the present invention to provide an improved passive safety system for use in a mobile storage system, which simplifies the construction and installation of cross-aisle sensors and quadrature sensors in the mobile storage units. It is another object of the invention to provide such an improved passive safety system which provides reliability in detecting the presence of persons or objects between adjacent mobile storage units and also senses direction of movement of persons or objects into or out of the aisle. A still further object of the invention is to provide a simplified and reliable method of sensing the presence of a person or object between adjacent mobile storage units and direction of movement of a person or object into or out of the aisle.

In accordance with a first aspect of the invention, a mobile storage system includes a number of storage units supported by a supporting surface, including at least a first storage unit that is movable toward and away from a second storage unit by operation of a drive arrangement to selectively create an aisle between the first and second storage units, in which the aisle is accessible from an end area. A sensing system detects the presence of persons or objects in the aisle and also detects the direction of movement of persons or objects into or out of the aisle. The sensing system includes a number of exit zone emitters and receivers located adjacent an end area of the first and second storage units that defines the end area of the aisle, and a number of inner emitters and receivers located along an inner area of the first and second storage units inwardly of the end area. The exit zone emitters and receivers and the inner emitters and receivers are located at generally the same elevation adjacent and above the supporting surface. In one form, each of the storage units includes a carriage and a storage member secured to the carriage. The carriage is movable relative to the supporting surface, and the exit zone emitters and receivers and the inner emitters and receivers are located on the carriage.

In accordance with another aspect of the invention, a mobile storage system includes presence and direction sensing means carried by the storage units for detecting the presence of persons or objects in the aisle and for detecting the direction of movement of persons or objects into or out of the aisle. The presence and direction sensing means includes an end sensing section, or exit zone, located adjacent at least an end area of the first and second storage units that defines the end area of the aisle, and an interior sensing section located inwardly of the end area. The end sensing section and the interior sensing section are interconnected with each storage unit via a sensor housing carried by the storage unit and located above the supporting surface. Each storage unit includes a carriage and a storage member secured to the carriage, and the sensor housing is located on the carriage. The end sensing section and the interior sensing section are located at generally the same elevation adjacent and above the supporting surface.

Another aspect of the invention contemplates a method of operating a mobile storage system that includes adjacent first and second storage units supported by a supporting surface. This aspect of the invention includes detecting the location of a person or object within an aisle between the first and second storage units adjacent an end area of the first and second storage units and along an inner area of the first and second storage units inwardly of the end area. The act of detecting the location of a person or object within an aisle is carried out so as to detect both the presence of the person or object and the direction of movement of the person or object, both of which are carried out at generally the same elevation adjacent and above the supporting surface, preferably using a series of emitters and receivers carried by the storage unit.

The invention also contemplates an improvement in a carriage for supporting a storage member for use in a mobile storage system in which the carriage is movable by operation of a drive arrangement relative to a supporting surface. In accordance with this aspect of the invention, the carriage includes an outwardly facing side area that is adapted to face an aisle formed in the mobile storage system when the carriage is positioned in spaced apart relationship relative to an adjacent storage member. A presence and direction detecting sensing system is interconnected with the outwardly facing side area, and includes a sensor housing having a series of exit zone sensors located adjacent at least an end area of the carriage, and a series of inner sensors located along at least an intermediate area of carriage inwardly of the end area. The sensor housing and the sensors are configured relative to the carriage so as to be at generally the same elevation adjacent and above the supporting surface when the carriage is positioned on the supporting surface. A power supply and communication arrangement is interconnected with the sensor housing, and is configured to supply power to the sensors and to communicate signals from the sensors to a controller.

The invention also contemplates a method of constructing a carriage for supporting a storage member for use in a mobile storage system, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 4 is a partial enlarged elevation view, with reference to line 4-4 of FIG. 3, showing components of the passive safety system exit zone in accordance with the present invention;

FIG. 5 is a section view taken along line 5-5 of FIG. 4;

DETAILED DESCRIPTION OF THE INVENTION

Figure 1:
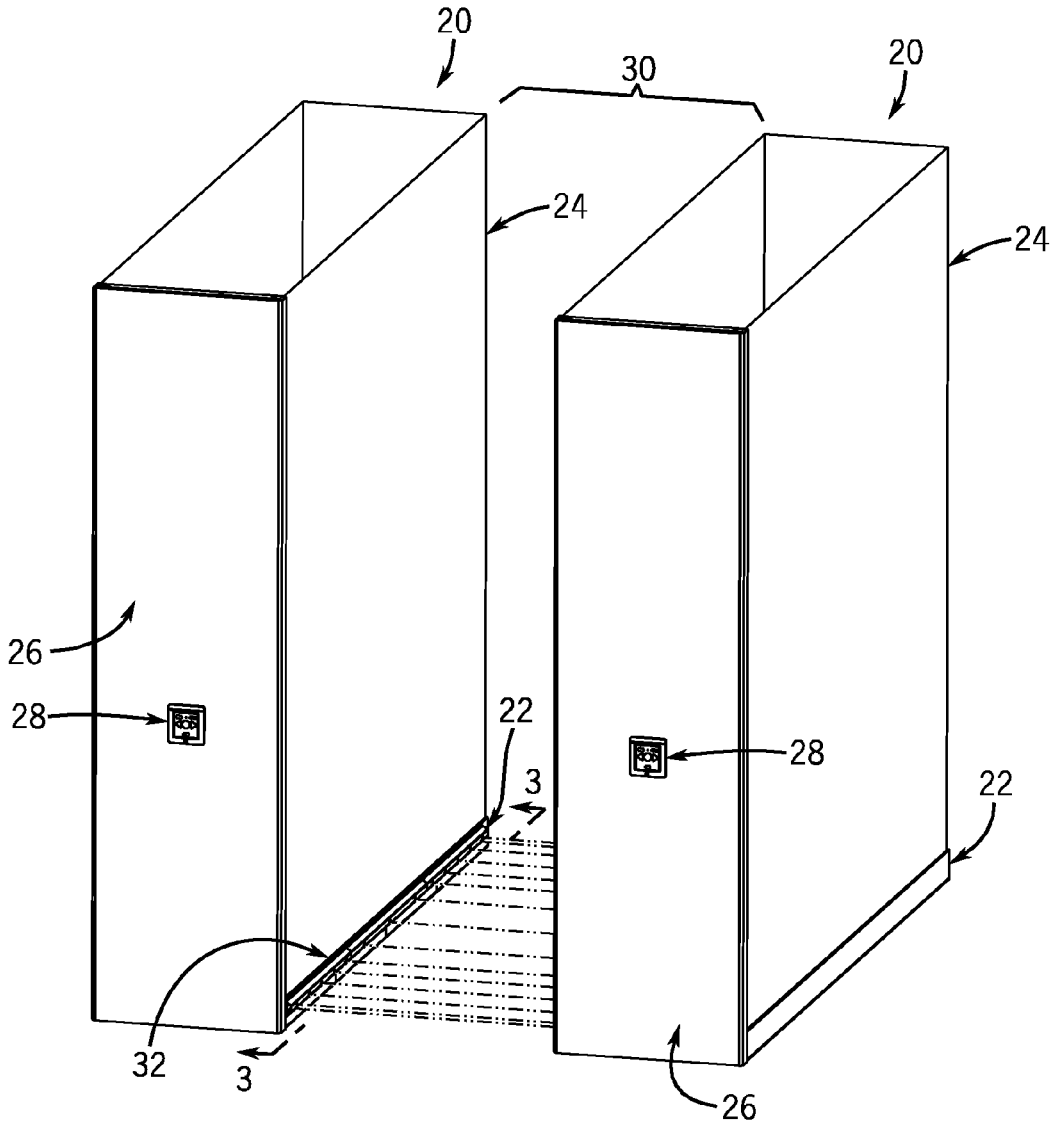
FIG. 1 is an isometric view of a representative pair of adjacent mobile storage units, such as are incorporated in a mobile storage system having a number of such units, incorporating the passive safety system exit zone in accordance with the present invention.
Figure 2:
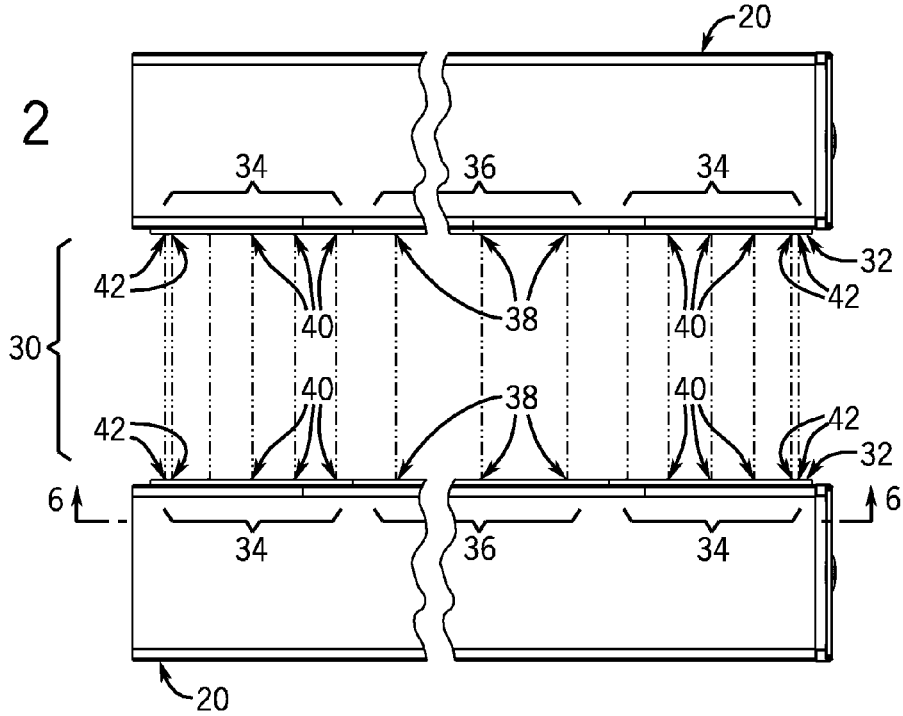
FIG. 2 is a top plan view of the mobile storage units of FIG. 1.

Referring to FIG. 1, a mobile storage system includes a series of mobile storage units, such as are shown at 20. While FIG. 1 illustrates a pair of mobile storage units 20, it is understood that the mobile storage system may include any desired number of storage units, and that the storage units may have any desired length, width, height and configuration. One or both of mobile storage units 20 may be moved both toward and away from the other, typically by means of wheels or rollers associated with the storage units 20 that are movable on rails or tracks mounted in a floor or other supporting surface, in a manner as is known. The storage units may be movable using any satisfactory known type of drive system, such as an electric motor-powered drive system.

In a typical construction, each mobile storage unit 20 may be in the form of a carriage 22 to which one or more storage members 24 are mounted. As is known, storage members 24 may be in the form of shelving units, cabinets, etc. Each carriage 22 typically includes spaced apart sets of wheels that are movable on the rails or tracks mounted in the floor or other supporting surface. Each carriage 22 also includes a drive arrangement, which typically includes an electric motor and a drive system interposed between the motor output and the wheels for providing movement of the storage unit 20. Representatively, each storage unit 20 may include an end panel 26 that includes an actuator pad 28 that is operated by a user to selectively operative the motor or other drive arrangement in order to move the storage unit 20 in a selected direction. In this manner, the adjacent storage units 20 can be selectively moved apart to create an aisle 30 therebetween, and can be selectively moved together to eliminate aisle 30.

A sensor system 32 is located at the lower extent of each storage unit 20. In the illustrated embodiment, sensor system 32 is provided along a side surface defined by carriage 22, which extends generally throughout the entire length of carriage 22. The sensor system 32 of each storage unit 20 interacts with a facing sensor system 32 of the adjacent storage unit 20 and is operable to detect the presence of objects or persons within aisle 30 in order to ensure that aisle 30 is clear before storage units 20 are moved together. The facing sensor systems 32 also are operable to detect the direction of movement of persons or objects into or out of the ends of the aisle 30. Each sensor system 32 is interconnected with a controller associated with the storage unit 20, to ensure that the motor or other drive arrangement for the storage unit 20 cannot be operated to move a storage unit 20 in a direction to close an aisle 30 if the aisle 30 is not clear of persons or objects, in a known manner.

Each sensor system 32 includes a pair of outer or exit zone sensor sections 34 and an inner or interior sensor section 36. The interior sensor section 36 includes a series of evenly spaced interior cross-aisle sensors 38 that are adapted to cooperate with the interior cross-aisle sensors 38 of the facing interior sensor section 36 in order to detect the presence of a person or object within aisle 30. Interior sensors 38 are spaced apart a predetermined distance, such as on 12 inch centers, throughout the length of the inner sensor section 34 of each storage unit 20.

Each exit zone sensor section 34 includes a series of exit zone sensors 40, which cooperate with the facing exit zone sensors 40 to detect the presence of a person or object in the exit area of the aisle 30. Each exit zone sensor section 34 further includes a pair of quadrature sensors 42 at the end area of the storage unit 20 at the point at which a user or object enters or exits the aisle 30. Quadrature sensors 42 function to sense the direction at which a person or object moves relative to aisle 30, i.e. into the aisle 30 or out of the aisle 30.

Representatively, the sensors 38, 40 and 42 may be conventional photocell-type sensors that both emit a light beam that extends across aisle 30 and receive a light beam from a sensor on the opposite side of aisle 30. That is to say, sensors 38, 40 and 42 are photo emitters and receivers, in a known manner, and provide a signal to a controller or the like indicative of whether an emitted light beam is blocked so as to prevent it from being received by the facing receiver in order to indicate the presence of a person or object within aisle 30 between the emitter and the receiver.

As noted above, sensors 38 of interior sensor section 36 are spaced apart a predetermined distance, e.g. on 12 inch centers. Exit zone sensors 40 are spaced apart a distance that is less than the spacing of sensors 38 of interior sensor section 36. Representatively, the spacing of exit zone sensors 40 may be 6 to 7 inches, and exit zone sensor section 34 has a sufficient length and number of exit zone sensors 40 to ensure that a person cannot step over the exit zone sensor section 34 when entering or exiting the aisle 30. The length of exit zone sensor section 34 may representatively be in the range of 24 inches to 36 inches, although a length of 28 inches has been found to provide satisfactory operation.

Quadrature sensors 42 are spaced very closely together, e.g. 1 inch apart, and are sequentially blocked as a person or object enters or exits aisle 30 so as to provide an indication as to the direction of movement of the person or object into or out of the aisle 30.

Figure 3:
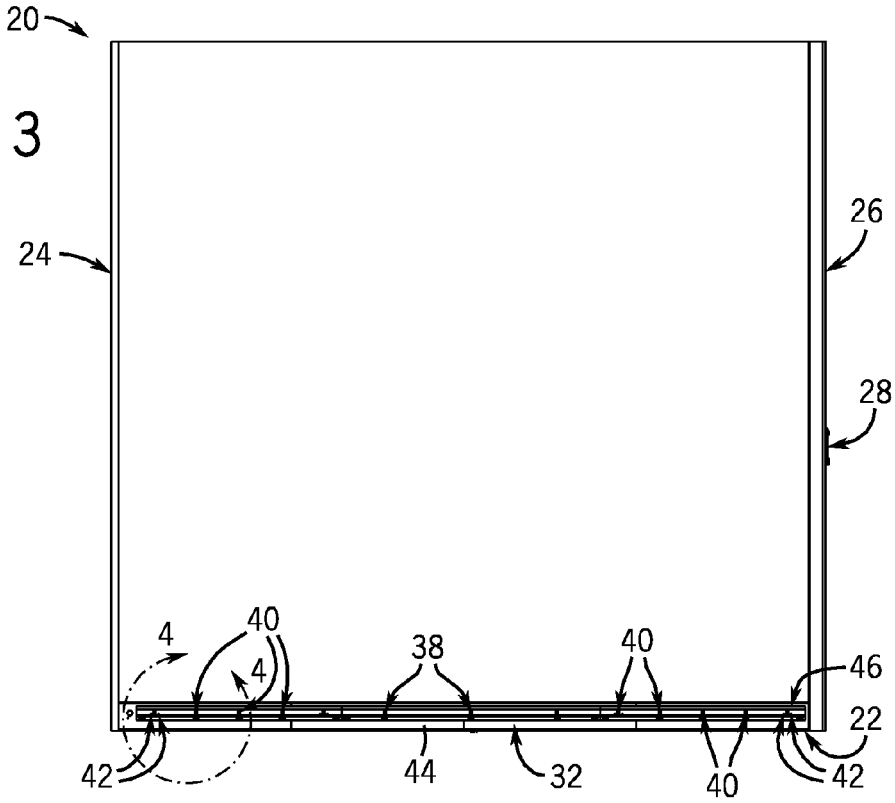
FIG. 3 is an elevation view of one of the mobile storage units, with reference to line 3-3 of FIG. 1.

As shown in FIGS. 3-5, each sensor system 32 is secured to a side wall 44 of one of the carriages 22. The sensors 38, 40, 42 are interconnected with the carriage side wall 44 by means of a sensor housing 46, which extends throughout the majority of the length of carriage 22. Representatively, sensor housing 46 may include a flange 48 that is employed to secure sensor housing 46 to the outer surface of carriage side wall 44. Sensor housing 46 may also include a series of walls including a bottom wall 50, a top wall 52 and a side wall 54, which cooperate with carriage side wall 44 to form a closed passage 56. Sensor housing 46 is located on carriage side wall 44 so as to be spaced a predetermined vertical distance above a supporting surface S, which may be a floor or the like, relative to which the storage unit 20 is movable. Representatively, sensor housing 46 may be located such that passage 56 is located at an elevation of approximately 2 to 6 inches above supporting surface S.

FIG. 5 illustrates one of the sensors 40 that is secured to carriage side wall 44 via sensor housing 46. It is understood that the illustration and description of sensor 40 applies equally to the manner in which sensors 38 and 42 are secured to carriage side wall 44 via sensor housing 46.

As shown in FIG. 5, each sensor 40 includes an emitter 58 and a receiver 60. Side wall 54 of sensor housing 46 includes an opening 62 in alignment with emitter 58, which enables a light beam from emitter 58 to exit the interior of sensor housing 46 and to project across aisle 30. Receiver 60 includes an outer head 64 and an inner mounting section 66, which extends through an opening in sensor housing side wall 54.

Figure 6:
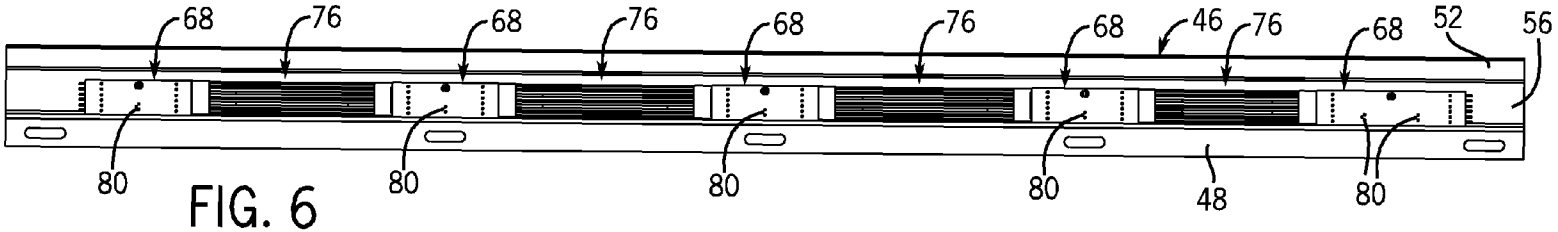
FIG. 6 is a rear elevation view, with reference to line 6-6 of FIG. 5, showing components of a power supply system for the components of the passive safety system including the exit zone.

As shown in FIG. 6, the passage 56 formed by each sensor housing 46 is adapted to receive the internal components of the sensors 38, 40, 42 as well as a power and communication distribution system for supplying electrical power to the sensors 38, 40, 42 and for communicating signals from the sensors 38, 40, 42 to the controller. Each of sensors 38, 40 and 42 is mounted to a sensor mounting board 68, which includes a pair of depending ears 70 that are engageable within slots 72 formed in sensor housing bottom wall 50. Each sensor mounting board 68 further includes a pair of power and communication connectors 74, and suitable conductors for providing electrical power and communication to the components of sensors 38, 40, 42 that are secured to board 68. A wire harness 76 is located between each set of adjacent sensor mounting boards 68 and includes connectors 78 at its ends, each of which is engageable with one of power and communication connectors 74 for supplying power and communication to the sensor mounting board 68. At the endmost sensor mounting board 68, a power supply and communication input/output is engaged with the endmost connector 74 for supplying power and communication to the system, which is then transferred between adjacent sensor mounting boards 68 by the wire harnesses 76.

Figure 7:
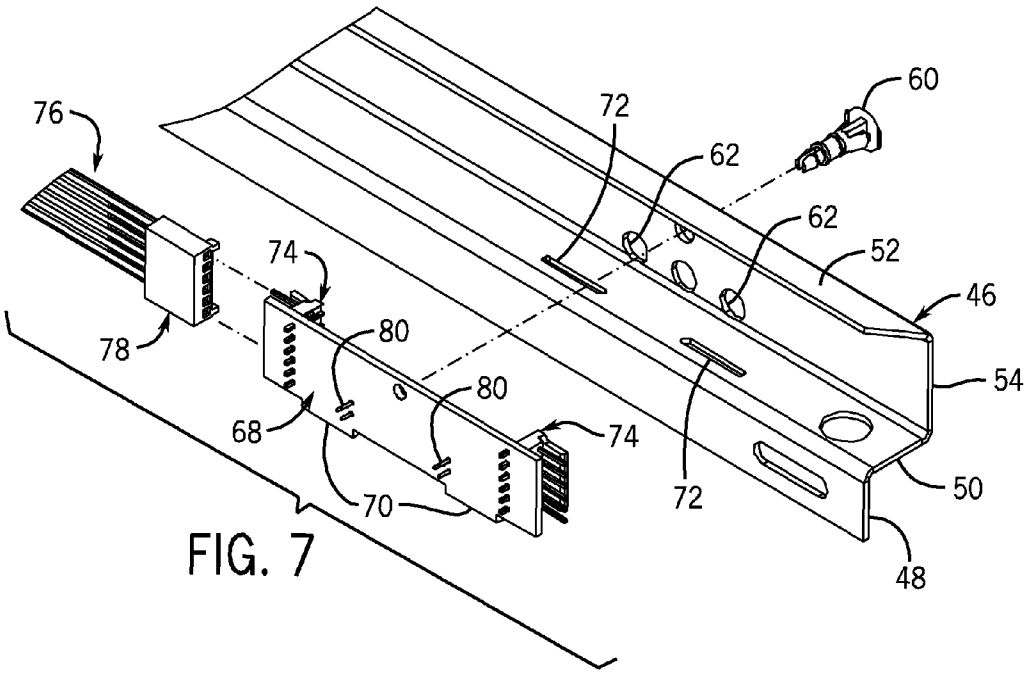
FIG. 7 is a partial exploded isometric view showing a portion of the power supply system of FIG. 6.

FIG. 7 illustrates an endmost sensor mounting board 68, which includes connections 80 for a pair of emitters 58 associated with quadrature sensors 42. The remaining sensor mounting boards 68 include single connections 80 for a single emitter 58 such as is associated with sensors 38 and 40.

In operation, the sensor systems 32 function as follows in order to detect the presence of a person or object within aisle 30 and to detect the direction of movement of a person or object into or out of aisle 30. As a person or object enters aisle 30, sensors 42 at the end of aisle 30 detect the inward movement of the person or object into the aisle 30 by means of the sensors 42 being sequentially blocked when the aisle 30 is entered. In the event a person steps over sensors 42, the person's foot will then obstruct one of the closely spaced exit zone sensors 40, and the next step of the user also obstructs an inner one of the exit zone sensors 40 so that the sequence of obstruction of sensors 40 provides an indication as to the direction of movement of the person into the aisle 30. When the person or object is in the aisle 30, certain of the interior sensors 38 or the exit zone sensors 40 are obstructed, to provide an indication that the person or object remains within the aisle 30. As the person or object exits the aisle 30, the person or object sequentially obstructs the exit zone sensors 40 to again provide an indication as to the direction of movement of the person or object out of the aisle 30. Quadrature sensors 42 provide a redundant indication as to movement of the person out of the aisle. Again, however, in the event the person steps over quadrature sensors 42, the sequential blocking of the exit zone sensors 40 as the user exits the aisle provides an indication that the user is exiting the aisle. When all of the sensors 38, 40 and 42 are clear, typically for a predetermined time period, the storage units 20 can be moved together to close aisle 30.

The present invention utilizes a logic system incorporated into the controller that enables the controller to continuously monitor the position of a person or object in an aisle, and to compare the present position of the person or object with the position at a predetermined earlier time, which enables the controller to sense the direction of movement of the person or object in the aisle. While the direction of movement of the person or object in the aisle can be sensed at any location along the length of the aisle, the exit zone and quadrature sensors enable the controller to determine direction of movement with a relatively high degree of precision at the exit zone of the aisle.

Figure 8:
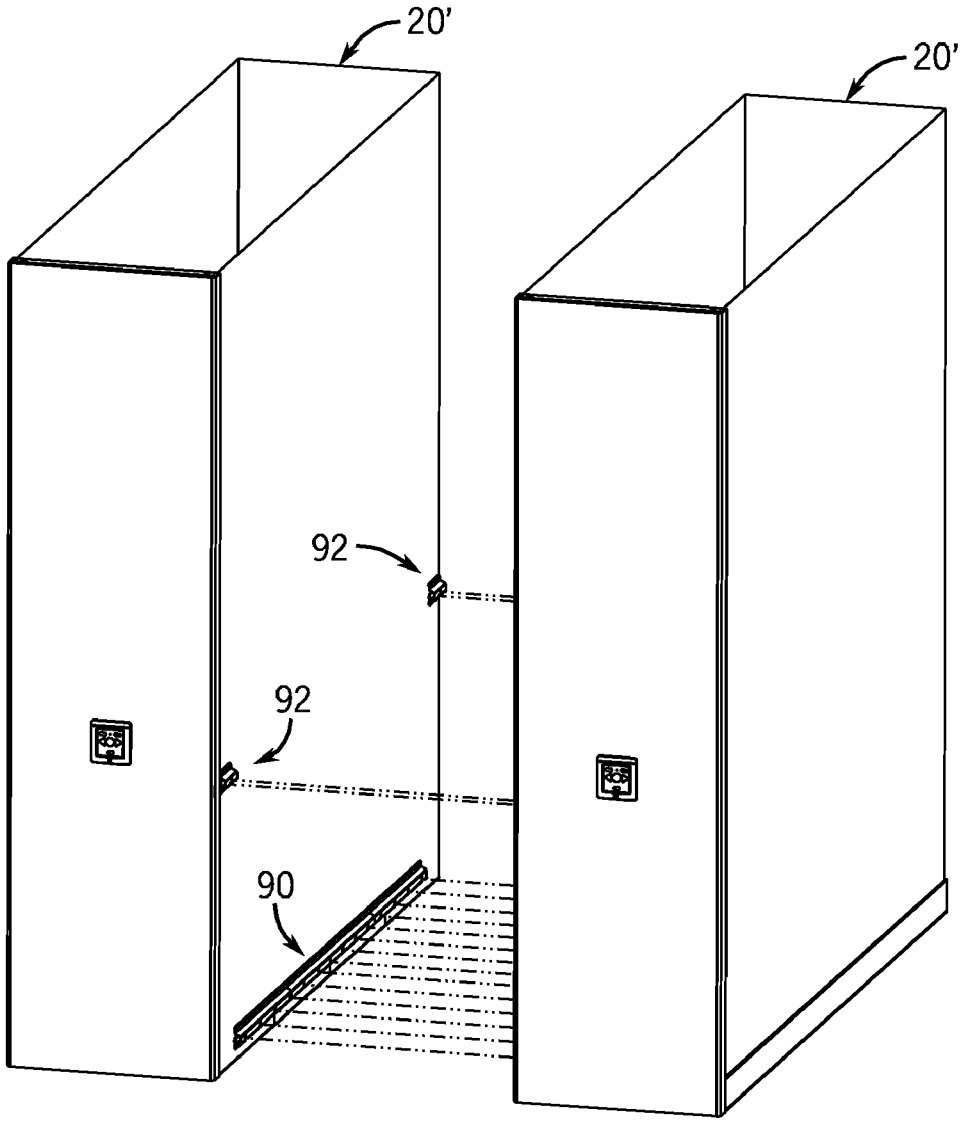
FIG. 8 PRIOR ART
FIG. 8 is a view similar to FIG. 1, showing the location and configuration of cross-aisle sensors and quadrature sensors in a prior art installation.
Figure 9:
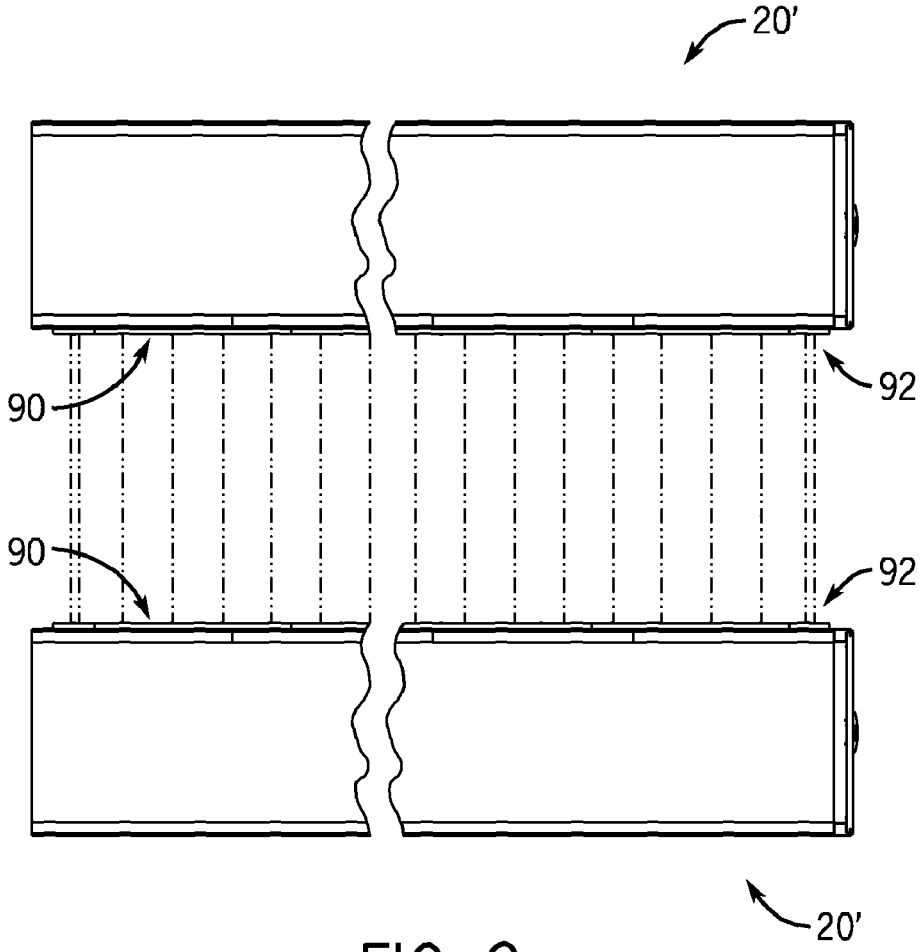
FIG. 9 PRIOR ART
FIG. 9 is a top plan view of the mobile storage units of FIG. 8, showing the positions of the cross-aisle sensors and the quadrature sensors.

FIGS. 8 and 9 illustrate a prior art sensor system for mobile storage units, such as 20'. In this configuration, a series of presence detection sensors 90 are located at the lower extent of each storage unit 20', again such as by mounting to the storage unit carriage or the like. Quadrature sensors 92 are located vertically above the presence sensors 90, typically at waist or knee height. The quadrature sensors 92 function to detect the direction of movement of a person or object into or out of the aisle between storage units 20'. While positioning quadrature sensors 92 above presence sensors 90 provides a reliable indication as to entry or exit of a person or object into or out of an aisle, the elevated quadrature sensors 92 must be mounted to the storage unit 20' separately from presence sensors 90 in separate housings, and additional wiring must be routed to the elevated quadrature sensors 92. Positioning the quadrature sensors 42 at the lower extent of the aisle 30 as in the present invention, in combination with the closely spaced exit zone sensors 40, enables the quadrature sensors 42 to be mounted to the carriage 22 along with the presence sensors 38 and the more exit zone sensors 40. This eliminates the need for the separate housing and mounting of the quadrature sensors, as well as routing of wiring to the separate quadrature sensors.

While the invention has been shown and described with respect to a particular embodiment, it is contemplated that various alternatives and modifications are contemplated as being within the scope of the present invention. For example, and without limitation, the sensors incorporated in the sensing system of the present invention are shown and described as having both an emitter and a receiver. As shown, this requires facing sensors on each side of the aisle. It is also contemplated that one or more of the sensors on one side of the aisle may be replaced with one or more reflectors. In this version, a beam emitted from a sensor on one side of the aisle is transmitted to the opposite side of the aisle, and is then reflected back and received on the same side of the aisle from which the beam is emitted. This configuration further reduces installation time and complexity of the sensor system.

Various alternatives and embodiments are contemplated as being within the scope of the following claims particularly pointing out and distinctly claiming the subject matter regarded as the invention.

We claim:

1. A mobile storage system, comprising:

a supporting surface;

a plurality of storage units supported by the supporting surface, including at least a first storage unit that is movable toward and away from a second storage unit by operation of a drive arrangement to selectively create an aisle between the first and second storage units, wherein the aisle is accessible from at least one entry-exit area defined by end areas of the first and second storage units; and a sensing system for detecting the presence of persons or objects in the aisle and for detecting the direction of movement of persons or objects into or out of the aisle, wherein the sensing system includes a plurality of direction-sensing outer emitters and receivers located adjacent the entry-exit area of the aisle, wherein the direction-sensing outer emitters and receivers are spaced closely together at an exit zone in the entry-exit area of the aisle and throughout at least a predetermined distance extending inwardly from the entry-exit area of the aisle, and wherein the sensing system further includes a plurality of presence-sensing inner emitters and receivers located along at least an in-aisle area of the first and second storage units inwardly of the area of the aisle that is occupied by the direction-sensing outer emitters and receivers, wherein both the direction-sensing outer emitters and receivers and the presence-sensing inner emitters and receivers are positioned at an elevation below the storage units and above the supporting surface and are operable to detect the presence of persons or objects in the aisle and to detect the direction of movement of persons or objects into or out of the aisle without the use of sensors positioned at an elevation above the direction-sensing outer emitters and receivers and the presence-sensing inner emitters and receivers, wherein the sensing system further includes a logic system that detects the sequence of obstruction of at least the direction-sensing outer emitters and receivers to detect the direction of movement of a person or object into or out of the aisle at the entry-exit area of the aisle;

wherein each exit zone of emitters and receivers comprises at least a pair of quadrature emitters and receivers at an endmost area of each of the storage units at the entry-exit area of the aisle, and wherein the exit zone further includes a plurality of the outer emitters and receivers located between the in-aisle area of each storage unit and the quadrature emitters and receivers, and wherein the inner emitters and receivers are each spaced a first distance apart in the in-aisle area of each of the first and second storage units, the outer emitters and receivers located between the in-aisle area of each storage unit and the quadrature emitters and receivers are each spaced apart a second distance less than the first distance, and the quadrature emitters and receivers are each spaced apart a third distance less than the second distance.

2. The mobile storage system of claim 1, wherein each of the storage units comprises a carriage and a storage member secured to the carriage, wherein the carriage is movable relative to the supporting surface, and wherein the inner emitters and receivers and the outer emitters and receivers are located on the carriage below the storage member.

3. The mobile storage system of claim 2, wherein the plurality of direction-sensing outer emitters and receivers and the plurality of presence-sensing inner emitters and receivers are interconnected with each storage unit via a sensor housing interconnected with the carriage below the storage member.

4. A method of operating a mobile storage system that includes adjacent first and second storage units supported by a supporting surface, comprising the acts of:

detecting the direction of movement of a person or object into or out of an aisle between the first and second storage units adjacent an end area of the first and second storage units that defines an entry-exit area of the aisle, using a plurality of direction-sensing outer emitters and receivers located adjacent the entry-exit area of the aisle, wherein the direction-sensing outer emitters and receivers are spaced closely together at the entry-exit area of the first and second storage units and throughout at least a predetermined distance extending inwardly from the entry-exit area, wherein the act of detecting the direction of movement of the person or object into or out of the aisle is carried out by detecting the sequence of obstruction of at least the direction-sensing outer emitters and receivers as the person or object moves into or out of the aisle through the entry-exit area of the aisle;

detecting the presence of a person or object in the aisle between the first and second storage units using a plurality of presence-sensing inner emitters and receivers located along an in-aisle area of the first and second storage units inwardly of the direction-sensing outer emitters and receivers;

wherein the acts of both detecting the direction of movement of the person or object at the entry-exit area and detecting the presence of a person or object in the aisle inwardly of the entry-exit area are carried out at generally the same elevation below the storage units and adjacent and above the supporting surface using the direction-sensing outer emitters and receivers and the presence-sensing inner emitters and receivers without the use of sensors positioned at an elevation above the direction-sensing outer emitters and receivers and the presence-sensing inner emitters and receivers;

wherein the act of detecting the direction of movement of the person or object is carried out using an exit zone of emitters and receivers that includes quadrature sensors and receivers at the entry-exit area of the aisle and a plurality of closely spaced presence sensing emitters and receivers located throughout the predetermined distance inwardly of the end area of the aisle between the quadrature sensors and receivers and the presence sensing inner emitters and receivers, and wherein the inner emitters and receivers are each spaced apart a first distance in the in-aisle area of each of the first and second storage units, the presence sensing emitters and receivers located between the quadrature sensors and receivers and the inner emitters and receivers are each spaced apart a second distance less than the first distance and the quadrature sensors and receivers are each spaced apart a third distance less than the second distance.

5. In a carriage for supporting a storage member for use in a mobile storage system in which the carriage is movable by operation of a drive arrangement relative to a supporting surface, an improvement comprising:

an outwardly facing side area that is adapted to face an aisle formed in the mobile storage system when the carriage is positioned in spaced apart relationship relative to an adjacent storage member;

a presence and direction detecting sensing system interconnected with the outwardly facing side area, including a sensor housing having a plurality of exit zone sensors located adjacent at least an end area of the carriage, wherein the exit zone sensors include quadrature sensors and receivers at an exit-entry end of the aisle and a plurality of presence-sensing emitters and receivers located inwardly of the quadrature sensors and receivers; wherein the guadrature sensors and receivers are each spaced apart a first, relatively close distance from each other throughout an exit zone that extends a predetermined distance inwardly from the end area of the carriage, and the presence sensing emitters and receivers located inwardly of the quadrature sensors and receivers are each spaced apart a second distance greater than the first distance, the sensing system further including a plurality of in-aisle sensors located along at least an intermediate area of carriage inwardly of the exit zone and at generally the same elevation of the plurality of exit zone sensors, wherein the in-aisle sensors are spaced apart from each other a third distance greater than the second distance; and a logic system that detects the sequence of obstruction of at least the exit zone sensors to detect the direction of movement of a person or object into or out of the aisle.

6. The improvement of claim 5, wherein the sensor housing and the exit zone and in-aisle sensors are configured relative to the carriage so as to be at generally the same elevation below the storage members and adjacent and above the supporting surface when the carriage is positioned on the supporting surface.

7. The improvement of claim 6, further comprising a power supply and communication arrangement interconnected with the sensor housing, wherein the power supply and communication arrangement is configured to supply power and communication to both the exit zone sensors and the in-aisle sensors.

* * * * *